US006527895B1

(12) United States Patent
Palmer

(10) Patent No.: US 6,527,895 B1
(45) Date of Patent: Mar. 4, 2003

(54) METHOD AND APPARATUS FOR MAKING A CELLULAR STRUCTURE

(75) Inventor: Roger C. Palmer, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 167 days.

(21) Appl. No.: 09/640,771

(22) Filed: Aug. 17, 2000

(51) Int. Cl.[7] ..... E06B 3/94

(52) U.S. Cl. ..... 156/197; 156/193; 156/204; 156/250; 156/291; 156/292; 156/65; 428/116; 428/118; 428/178; 160/84.05; 160/84.01

(58) Field of Search ..... 156/193, 197, 156/204, 250, 291, 292, 65, 200, 203, 217, 227, 264, 178; 428/118, 178; 160/84.05

(56) References Cited

U.S. PATENT DOCUMENTS

| | | | |
|---|---|---|---|
| 765,412 | A | 7/1904 | Budwig |
| 2,201,356 | A | 5/1940 | Terrell |
| 2,610,934 | A | 9/1952 | Steele |
| 2,734,843 | A | 2/1956 | Steele |
| 2,803,578 | A | 8/1957 | Holland |
| 3,055,419 | A | 9/1962 | Rubin et al. |
| 3,074,839 | A | 1/1963 | May et al. |
| 3,077,223 | A | 2/1963 | Hartsell et al. |
| 3,082,141 | A | 3/1963 | Steele et al. |
| 3,166,456 | A | 1/1965 | White et al. |
| 3,189,501 | A | 6/1965 | White et al. |
| RE26,444 | E | 8/1968 | Paige |
| 3,953,110 | A | 4/1976 | Charoudi |
| 4,109,587 | A | 8/1978 | Jansen, Jr. |
| 4,247,583 | A | 1/1981 | Roy |
| 4,288,485 | A | 9/1981 | Suominen |
| 4,307,768 | A | 12/1981 | Anderson |
| 4,346,132 | A | 8/1982 | Cheng et al. |
| 4,347,887 | A | 9/1982 | Brown |
| 4,388,354 | A | 6/1983 | Suominen |
| 4,450,027 | A | 5/1984 | Colson |
| 4,631,108 | A | 12/1986 | Colson |

(List continued on next page.)

FOREIGN PATENT DOCUMENTS

| | | |
|---|---|---|
| CA | 549831 | 12/1957 |
| CH | 403 461 | 6/1966 |
| DE | 28 40 023 | 3/1980 |
| GB | 756270 | 7/1954 |
| GB | 717072 | 10/1954 |
| GB | 832763 | 4/1960 |
| GB | 981875 | 1/1965 |
| GB | 988064 | 4/1965 |
| GB | 1216469 | 12/1970 |
| GB | 1 308 296 | 2/1973 |
| GB | 1 397 812 | 6/1974 |
| GB | 2 236 551 | 4/1991 |
| GB | 2 242 470 | 10/1991 |
| GB | 2 247 698 | 3/1992 |
| SE | 148862 | 6/1952 |

*Primary Examiner*—Deborah Jones
*Assistant Examiner*—Vivek Koppikar
(74) *Attorney, Agent, or Firm*—Marshall, Gerstein & Borun

(57) ABSTRACT

A multiple cell window covering having a fold and a tab is constructed using a strip of fabric as the input, which is then folded, welded, prepared with adhesive, stacked, and cured in an oven. The apparatus used to construct double, triple, and multi-cell honeycomb products includes a folder, ultrasonic welder, adhesive applicator and drier, a fabric accumulator, a cutter, a stacker, and an oven.

36 Claims, 4 Drawing Sheets

U.S. PATENT DOCUMENTS 4,631,217 A 12/1986 Anderson
4,676,855 A 6/1987 Anderson
4,677,012 A 6/1987 Anderson
4,677,013 A 6/1987 Anderson
4,732,630 A 3/1988 Schnebly
4,849,039 A 7/1989 Colson et al.
4,885,190 A 12/1989 Schnebly
4,984,617 A 1/1991 Corey
4,999,073 A 3/1991 Kao et al.
5,002,628 A * 3/1991 Schnebly ..... 156/379
5,015,317 A 5/1991 Corey et al.
4,603,072 A 6/1991 Colson
5,043,038 A 8/1991 Colson
5,043,039 A 8/1991 Swiszcz
5,097,884 A 3/1992 Sevcik et al.
5,106,444 A 4/1992 Corey et al.
5,129,440 A 7/1992 Colson
5,152,647 A 10/1992 Sewell
5,160,563 A 11/1992 Kutchmarek et al.
5,193,601 A 3/1993 Corey et al.
5,205,333 A 4/1993 Judkins
5,228,936 A 7/1993 Goodhue
5,313,998 A 5/1994 Colson et al.
5,455,098 A 10/1995 Cheng
5,482,750 A 1/1996 Colson et al.
5,525,395 A 6/1996 Huang
5,560,976 A 10/1996 Huang
5,630,898 A * 5/1997 Judkins ..... 156/204
5,654,073 A 8/1997 Swiszca et al.
5,690,778 A 11/1997 Swiszcz et al.
5,691,031 A 11/1997 Swiszcz et al.
5,692,550 A 12/1997 Ford et al.
5,701,940 A * 12/1997 Ford et al. ..... 160/84.05
5,702,552 A 12/1997 Kutchmarek et al.
5,706,876 A 1/1998 Lysyj
5,714,034 A 2/1998 Goodhue
5,746,266 A 5/1998 Colson et al.
5,834,090 A 11/1998 Huang
5,837,084 A 11/1998 Barss
5,974,763 A 11/1999 Colson et al.
6,206,075 B1 * 3/2001 Prince et al. ..... 160/84.05
6,319,586 B1 * 11/2001 Colson ..... 160/84.05

* cited by examiner

FIG. 1
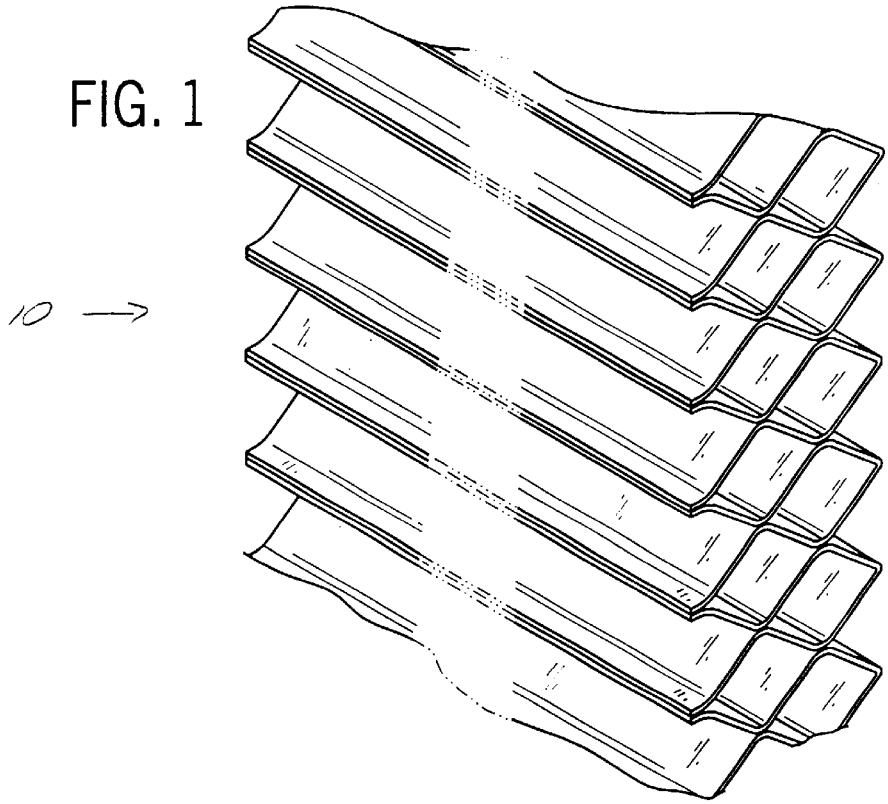
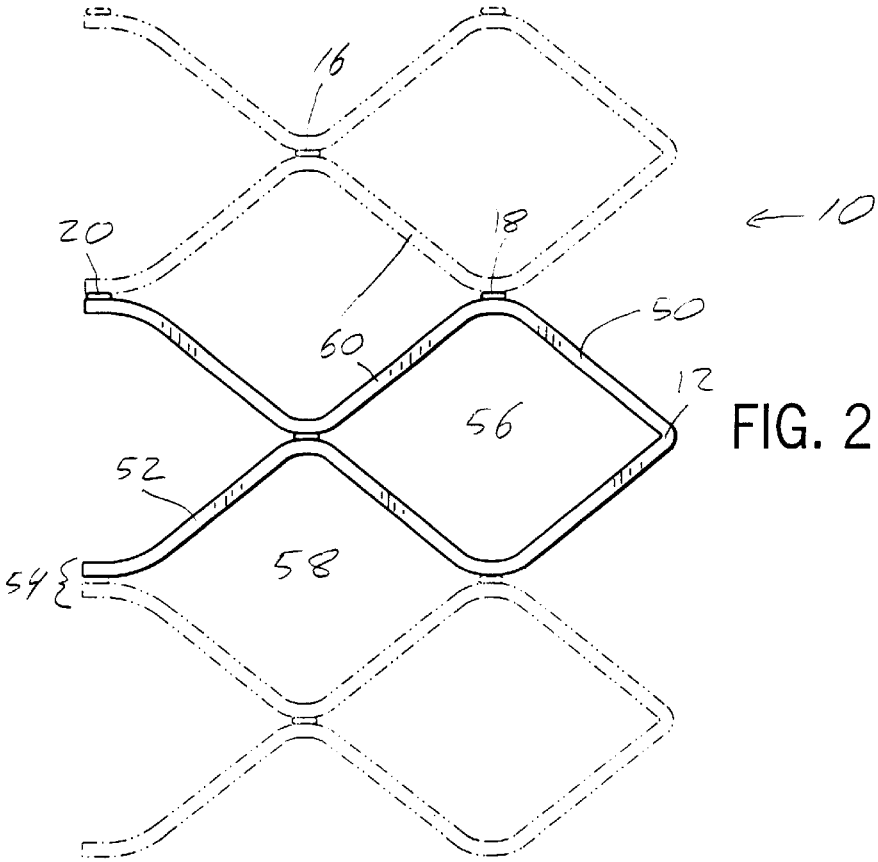
FIG. 2

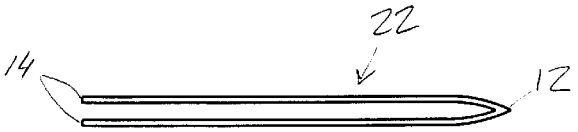
FIG. 3A
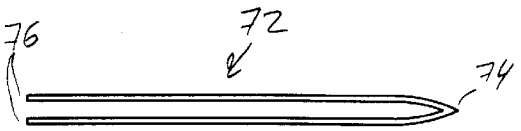
FIG. 4A
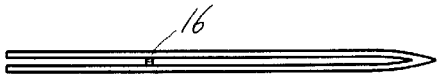
FIG. 3B
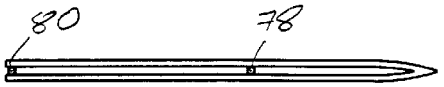
FIG. 4B
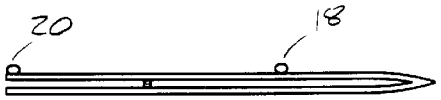
FIG. 3C
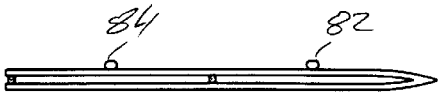
FIG. 4C
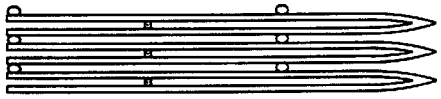
FIG. 3D
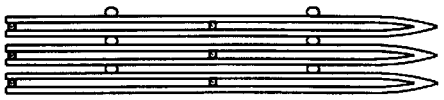
FIG. 4D
FIG. 5
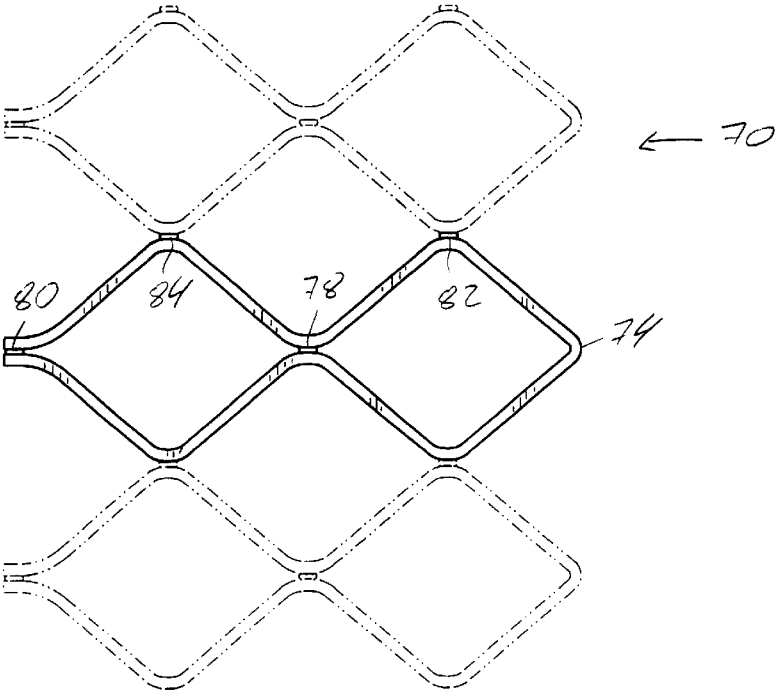

METHOD AND APPARATUS FOR MAKING A CELLULAR STRUCTURE

FIELD OF THE INVENTION

The present invention relates to a method and apparatus for manufacturing cellular window coverings. More particularly, the invention relates to a multi-cellular window covering with a pleated face and a tabbed face.

BACKGROUND OF THE INVENTION

There are several types of products in the field of cellular window blinds. These include single cell and multiple cell products. There are also pleated exterior surfaces and tabbed exterior surfaces and mixtures thereof. The materials used in different cellular shade products are likewise of a wide variety.

There are several methods used to make multiple cell products. One method utilizes a single sheet of material that is accordion folded to form a plurality of pleats. Each pleat is adhesively attached to an adjacent pleat at selected positions so as to make different products.

The single sheet and accordion fold method of producing cellular window shades begins with a sheet is shown in U.S. Pat. No. 5,702,552 to Kutchmarek et al. This patent discloses a method of making a pleated window covering using a single web of material, folded transversely to form pleats. Each pleat is adhesively attached to an adjacent pleat. This method results in a product with folds on both faces, and the width of the resultant product is limited by the size of the web of material.

The single sheet and accordion method is also illustrated in U.S. Pat. No. 5,630,898 to Judkins which discloses a method of making a final product that has folds on one face. In order to obtain the tab on side of the finished product and a fold on the other side of the finished product, an intermediate product with two pleated surfaces is created. This intermediate product has to be split in order to create the final fold and tab product. This method has the limitation discussed above, in that the width of the product is limited to the width of the sheet employed. Additionally, this method results in wasted materials, as a second cutting processing step is required and there is scrap left from the cut portion of the intermediate product.

Another method of making cellular products is to use a strip of material as the input. Using a strip of fabric rather than a sheet allows a wider variety of configurations to be made because the width of the final product is not limited to the width of the sheet material as it is with the single sheet method. With both the sheet method and the strip method of producing cellular products, both single and multi-celled products can be made.

U.S. Pat. No. 5,834,090 to Huang discloses a strip process in which individual strips of material are folded and attached together with an adhesive to create a cellular structure. As shown in FIGS. 7–13 of '090 the referenced patent, the sheets are folded into a variety of configurations before adhesively attaching the sheets together. All of the configurations though result in a product with two pleated faces rather than a fold and tab appearance.

Thus there is a need and desire for an efficient method and apparatus for making a multiple cell window covering that does not use the accordion method of manufacture, and results in a product with a fold and tab appearance. It would also be desirable for a method and apparatus for making a multiple cell window covering that does not require a longitudinal cut at an intermediate stage of the product manufacturing process in order to make the final product.

SUMMARY OF THE INVENTION

One method of making a double cell window shade includes providing a length of material, folding the length in half to form a fold, two free ends, a top half, and a bottom half, one of the halves having an outer surface. The top half is then attached to the bottom half along a line located greater than half the distance from the fold to the free ends. A first adhesive is applied to the outer surface along a line located less than half the distance from the fold to the free ends. A second adhesive is applied to the outer surface along a line proximate the free ends. The length of material is cut into individual strips and stacked such that the lines of adhesive of each strip make contact with the adjacent individual strip.

Another embodiment of the method of making a double cell window shade includes providing strips of material, folding each strip longitudinally to form a fold, two free ends, a top half, and a bottom half, one of the halves having an outer surface. The top half of each strip is attached to the bottom half of the same strip along a line two-thirds of the distance from the fold to the free ends. A first adhesive is applied to the outer surface of each strip along a line one-third of the distance from the fold to the free ends. A second adhesive is applied to the outer surface of each strip along a line proximate the free end. The strips are stacked such that the adhesives of each strip make contact with the next overlying strip.

A method of making a triple cell window shade includes providing a length of material, folding the length longitudinally to form a fold, two free ends, a top half and a bottom half, one of the halves having an outer surface. The top half is attached to the bottom half along a first longitudinal line between the fold and the free ends, and along a second longitudinal line proximate the free ends. A first adhesive is applied to the outer surface along a line closer to the fold than the first longitudinal line, and a second adhesive is applied to the outer surface along a line between the longitudinal line and the first adhesive. The length of material is cut into individual strips that are stacked.

A method of making a multi-cell honeycomb product includes providing a length of material, folding the length longitudinally to form folded material, the folded material having a fold, two free ends, a top half, and a bottom half, one of the halves having an outer surface. The folded material is divided into a plurality of longitudinal segments, one through N, the first segment beginning at the fold, the Nth segment ending at the free ends. The top half is attached to the bottom half along lines located in selected segments and adhesive lines are applied to the outer surface along lines located in other segments. The folded material is cut into a plurality of individual strips of material, and those individual strips are stacked.

An apparatus for manufacturing a multi-cell fold and tab honeycomb product includes a folder, an ultrasonic welder receiving the output of the folder, an adhesive applicator receiving the output of the ultrasonic welder, a stacker for stacking the output of the adhesive applicator, and an oven for baking the contents of the stacker. The product has a folded face and a tabbed face.

BRIEF DESCRIPTION OF THE DRAWINGS

FIG. 1 is a perspective view of a double cell window shade product.

FIG. 2 is a cross-sectional view of a double cell window shade product.

FIG. 3A is a cross-sectional view of a folded strip of fabric.

FIG. 3B is a schematic cross-sectional view of a folded strip of fabric showing the location of a weld.

FIG. 3C is a schematic cross-sectional view of a folded strip of fabric showing the locations of a weld and adhesive beads.

FIG. 3D is a schematic cross-sectional view of a stack of folded strips of fabric showing the location of welds and adhesive beads in a double cell window shade product.

FIG. 4A is a cross-sectional view of a folded strip of fabric.

FIG. 4B is a schematic cross-sectional view of a folded strip of fabric showing the location of two welds.

FIG. 4C is a schematic cross-sectional view of a folded strip of fabric showing the locations of welds and adhesive beads.

FIG. 4D is a schematic cross-sectional view of a stack of folded strips of fabric showing the location of welds and adhesive beads in a triple cell window shade product.

FIG. 5 is a cross-sectional view of a triple cell window shade product.

DETAILED DESCRIPTION OF THE PREFERRED EMBODIMENTS

Figure 6:
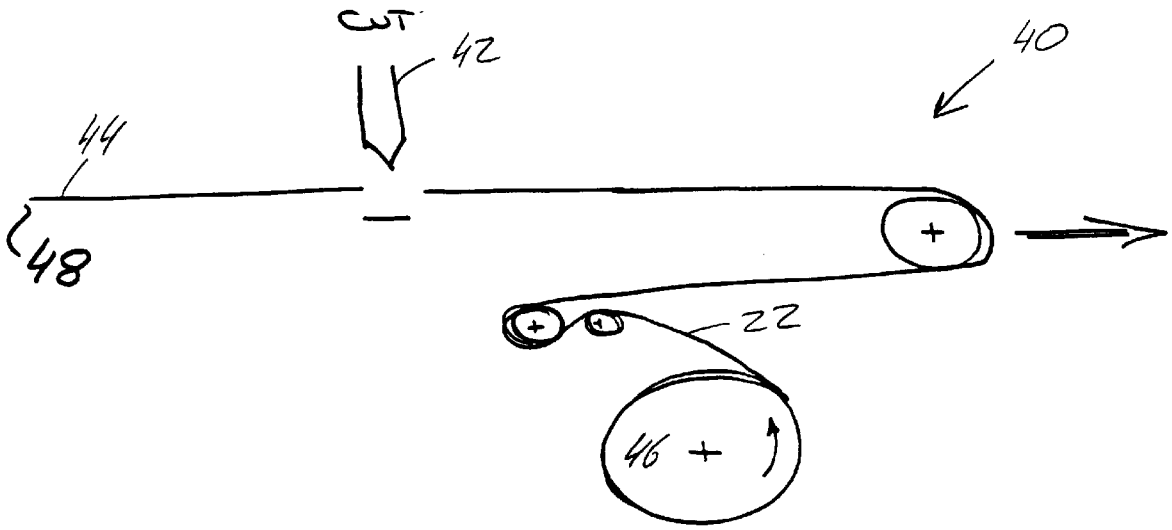
FIG. 6 is schematic view of a fabric accumulator.

Referring to FIG. 1, a double celled window blind 10 is shown. The process for manufacturing the double cell product is illustrated in FIGS. 3A through 3D. A cross-sectional view of the double cell blind 10 is illustrated in FIG. 2. The method of manufacturing and the resulting structure of the double cell embodiment will be discussed first, followed by methods used to manufacture triple cell and other multiple cell embodiments.

Referring to FIGS. 3A through 3D, the first step of manufacturing the double cell embodiment is to create folded material 22 by folding in half a continuous strip or length of material having a predetermined width to form a fold 12, and two free ends 14. In an alternative embodiment, individual strips of material could be folded. The second step is to secure the folded material 22 to itself with a sonic weld, at a location 16, equal to two-thirds the overall width of the folded material as measured from the fold 12. The folded material 22 could also be secured together with an adhesive glue bead that would be applied to the material prior to the material being folded in half. Alternatively, the adhesive can be applied with an applicator after the material 22 has been folded in half.

The next step of the process includes applying two continuous glue beads 18, 20 to the top portion of the folded material 22 at a distance equal to one-third the overall distance from the fold 12 and at the point furthest from the fold respectively. Of course, intermittent beads of glue would also work adequately. The glue beads 18, 20 are then dried, but not cured, to permit the folded material 22 to be rolled about a take-up spool 46 for later processing. The glue beads 18, 20 applied to the top of the material do not adhere to an adjacent portion of the continuous material on the take-up roll because it is dried. In an alternative embodiment, the glue is not dried first, and the folded material 22 proceeds to the next process step without being rolled about the take-up spool 46.

Figure 7:
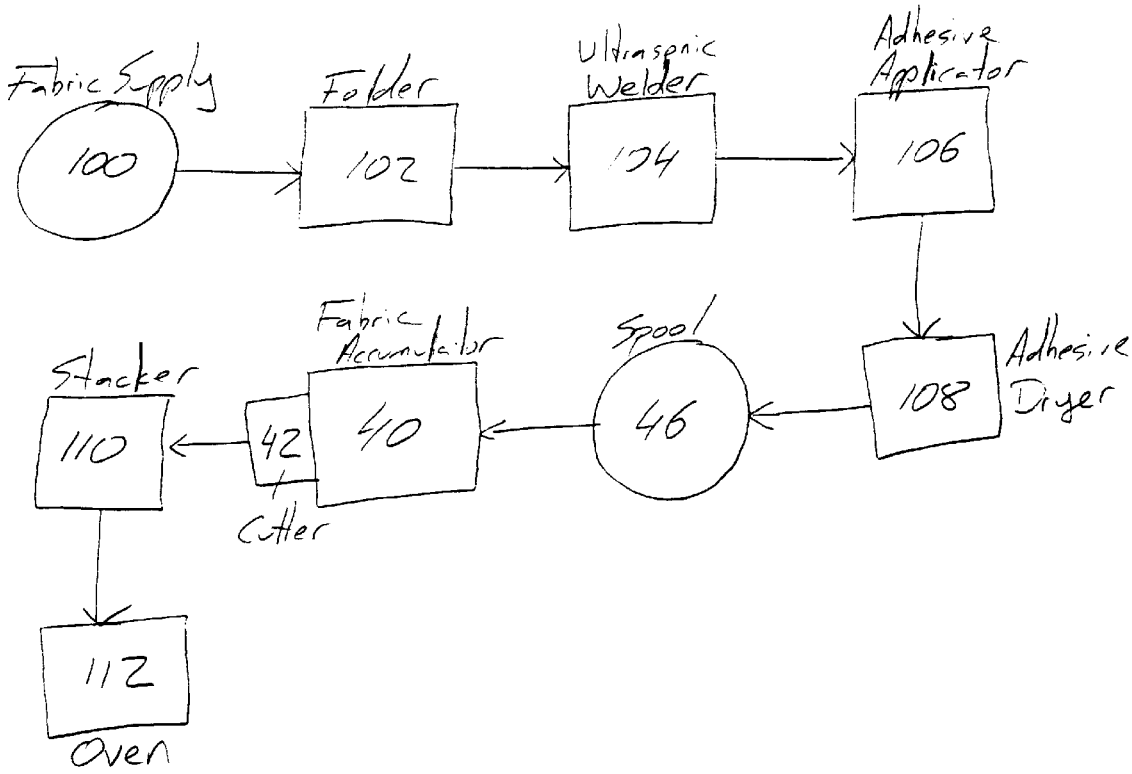
FIG. 7 is a flow chart illustrating the components of a machine used to make multi-cell window shade products.

Referring to FIGS. 6 and 7, the double cell shade 10 is formed by cutting equal size strips from the continuous folded material 22 and stacking the strips for subsequent curing of the adhesive beads. First, the leading edge 48 of the folded material 22 with the dried glue beads 18, 20 is fed through a fabric accumulator 40 and a predetermined distance past a cutter 42. The leading edge 48 of the folded material 22 is then stopped while the material is cut to form the first strip 44. The spool 46 continues to unwind during the cutting step and material is stored in the fabric accumulator 40. Once the first strip 44 is cut, it is pushed downward between two supporting plates into a stacker 110. The newly formed leading edge 48 of the folded material 22 is then moved forward to permit the cutting of the second strip. The fabric accumulator 40 permits the material to be fed continuously from spool 46 both while the new leading edge 48 of the folded material 22 is stopped during the cutting operation and while the leading edge 48 of material is moved past the cutter 42. The cutting step is repeated until a sufficient number of strips 44 are gathered in the stacker 110. If individual strips of material are folded rather than a continuous length, the fabric accumulator 40 and cutter 42 may be omitted by having the folded material 22 proceed directly to the stacker 110.

The stacked strips are then cured in an oven 112 to activate the adhesive beads 18, 20 thereby bonding adjacent strips. Where an adhesive bead is used instead of an ultrasonic weld to secure the folded portions of the material to itself, the curing step cures this adhesive bead as well.

A cross section of the finished double cell product 10 is illustrated in FIG. 2. One side of the double cell product 10 includes cells having a front, or outward wall 50 with an apex formed by the fold 12 of each strip, while the other side of the double cell product includes cells having a rear, or outward wall 52 with a tab or fin 54 formed by the one end of one of the free edges of one strip secured to a respective end of a free edge of an adjacent strip.

The front of the double cell product includes a plurality of front cells 56. Each front cell 56 includes an outwardly facing wall 50 defined by a pair of front wall portions joined together at the fold 12. The rear of the double cell product includes a plurality of rear cells 58. Each rear cell 58 includes an outwardly facing wall 52 defined by a pair of rear wall portions joined together at the tab 54 formed by one free end respectively of adjacent strips. The inwardly facing walls or center walls 60 of the front and rear cells are formed from a pair of center wall portions.

The double cell product 10 geometry is such that the front walls 50, rear walls 52 and center walls 60 all have the same length. If the double cell product is fully extended, all of the walls would be substantially vertical and co-planar.

In alternative embodiments, the front walls 50, rear walls 52 and center walls 60 do not have the same length. In a first alternative embodiment, the rear walls 52 are substantially vertical and co-planar, while the front walls 50 and center walls 60 are not in a co-planar orientation, when the product is fully extended.

In another alternative embodiment, the center walls 60 and rear walls 52 are substantially vertical and co-planar when the double cell product 10 is fully extended and the front walls 50 are not co-planar and substantially vertical.

In still another alternative embodiment, the center walls 60 are substantially vertical and coplanar when the double cell product 10 is fully extended and the front and rear walls 50, 52 are not coplanar and not substantially vertical.

It should be noted however, that in the preferred embodiment, the shade 10 is never fully extended such that all of the cells include any wall portions that are coplanar and substantially vertical. The different geometry of the products is achieved by varying the location and relative distance of the adhesive beads 18, 20 and or ultrasonic welds 16.

Referring to FIGS. 4A through 4D, the process for manufacturing a triple-cell product 70 is similar to that used for the double cell product 10. As in the double cell embodiment, the first step of manufacturing the triple cell product 70 is to fold in half a continuous strip or length of material 72 having a predetermined width to form a fold 74. In this way the two free ends 76 are adjacent one another. The second step is to sonically weld the material to itself at two places, the halfway point 78 and at the free ends 80. As noted above, if the material is to be secured with an adhesive, the adhesive beads could be placed on the material prior to, concurrent with, or after the folding step.

Similar to the process for manufacturing a double cell product 10, the third step of the process for manufacturing the triple cell product 70 includes applying two continuous glue beads 82, 84 to the top portion of the folded material at a distance equal to one-quarter and three-quarters the distance from the folded edge 74. The material is then processed as discussed above with respect to the double cell product 10. FIG. 5 depicts a cross-section of the finished triple cell product. Also contemplated are alternative embodiments having varying geometry as discussed above with respect to the double cell product 10.

The method discussed herein may also be extended to any multi-cell embodiment. Once the strip or length of material is folded, the halves may be attached together along any number of lines, and adhesive applied to the outer surface along other lines such that the final product has a multiple cell configuration. For example, to make an octuple cell product, the folded strip should be divided into nine longitudinal segments, the first including the fold, and the ninth including the free ends. The upper half and lower half of the strip would be welded together in the even numbered segments, and the adhesive lines would be applied to the outer surface of the folded strip in the odd segments. Note that the width of the various segments may be varied depending on the desired final product configuration.

In an alternative embodiment, the strip would not be folded into two equal longitudinal halves. One free end could overlap the other free end of the folded strip for aesthetic reasons.

Referring to FIGS. 6 and 7, the machine for making cellular structure has the following major elements. A fabric supply 100 is fed into the machine. The fabric is folded in half by a folder 102 that creases the folded end of the fabric. The folded material 22 is then fed into an ultrasonic welder 104. The ultrasonic welder 104 welds the two folded halves together. The folded material 22 is then fed into an adhesive applicator 106. For a double cell structure, the adhesive applicator 106 applies two continuous or intermittent glue beads as discussed above. After the glue beads have been applied, an adhesive dryer 108 is used to dry but not cure the glue beads such that the fabric strip may be rolled back up onto a spool 46 without having the glue beads attach to adjoining fabric.

In the preferred embodiment, the material on spool 46 is subsequently fed into the fabric accumulator 40 having idler pulleys 70 and a traveling pulley 72. Travelling pulley 72 moves away from idler pulleys 70 when the leading edge of the fabric is stopped to permit cutting of the material. Once a length of material is cut the new leading edge of the folded material is moved forward past the cutting station. During this stage, the travelling pulley 72 moves toward idler pulleys 70. In this manner, material may be fed continuously from spool 46.

As discussed above a cutter 42 cuts the fabric into preset lengths. The cut pieces of fabric are placed into a stacker 110. The stacker 110 holds a number of the cut pieces of fabric 44 in a stacked arrangement. The stacked fabric is then cured in an oven 112. This oven 112 activates the glue beads. Once the glue has been bonded, the cellular structure is complete. The finished product may then be removed from the oven 112.

In the preferred embodiment, the fabric supply 100 is a roll of fabric that is fed into the machine. Thus, this apparatus differs from other machines that create cellular structures from sheets of fabric. This provides the advantage of a final product that is not limited in width by the sheet of input fabric.

In an alternative embodiment, separate strips of fabric could be input into the apparatus. If discrete segments are fed into the folder 102, the strips could then travel to the ultrasonic welder 104 and the adhesive applicator 106 and proceed directly into the stacker 110 where the strips could be stacked and attached. This embodiment would eliminate the requirement for the adhesive dryer 108, and cutter 42 because the strips could be fed into the stacker before the adhesive has dried, and the individual strips could be fed into the folder already cut to the desired length.

The ultrasonic welder 104 which is used to secure the two halves of the folded fabric 22 is the preferred embodiment. However, in an alternative embodiment, the two halves of the strip of fabric could be attached using an adhesive.

In the preferred embodiment, the adhesive applicator 106 applies glue beads as the fabric is fed through the machine. These glue beads are laid on top of the folded fabric 22.

The width of the final product is determined by the distance the folded strip of material is fed into the fabric accumulator 40 before being cut by the cutter 42. In the preferred embodiment, the cutter 42 is a blade. In the alternative embodiment where individual strips are fed into the apparatus, the cutter 42 may not be necessary, although it may be used to change the width of the final product if the input strips are not the desired length.

While several embodiments of the invention have been described, it should be apparent to those skilled in the art that what has been described is considered at present to be the preferred embodiments of a method and apparatus for making a cellular structure. However, in accordance with the patent statutes, changes may be made in the design without actually departing from the true spirit and scope of this invention. For example, it is once the material is folded, welded and adhesive applied as discussed above, the material need not be wound onto a spool but may be fed into the fabric accumulator. The following claims are intended to cover all such changes and modifications which fall within the true spirit and scope of this invention.

What is claimed is:

1. A method of making a double cell window shade comprising:

providing a length of material;

folding the length in half longitudinally to form a fold, two free ends, a top half, and a bottom half, one of the halves having an outer surface;

attaching the top half to the bottom half along a line located greater than half the distance from the fold to the free ends;

applying a first adhesive to the outer surface along a line located less than half the distance from the fold to the free ends;

applying a second adhesive to the outer surface along a line proximate the free ends;

cutting the length of material into individual strips of material; and stacking the individual strips such that the lines of adhesive of each strip make contact with the adjacent individual strip.

2. The method of claim 1, wherein the top half is attached to the bottom half with a third adhesive.

3. The method of claim 1, wherein the top half is attached to the bottom half with an ultrasonic weld.

4. The method of claim 1, wherein the first and second adhesives are allowed to dry prior to stacking the individual strips.

5. The method of claim 1, wherein the first and second adhesives are glue beads.

6. The method of claim 1, wherein the top half is attached to the bottom half along a line located two-thirds of the distance from the fold to the free ends, and the first adhesive is applied along a line located one-third of the distance between the fold and the free ends.

7. The method of claim 1, wherein the top half and the bottom half are of equal width.

8. A method of making a double cell window shade comprising:

providing strips of material;

folding each strip longitudinally to form a fold, two free ends, a top half, and a bottom half, one of the halves having an outer surface;

attaching the top half of each strip to the bottom half of the same strip along a line two-thirds of the distance from the fold to the free ends;

applying a first adhesive to the outer surface of each strip along a line one-third of the distance from the fold to the free ends;

applying a second adhesive to the outer surface of each strip along a line proximate the free end; and stacking the strips such that the adhesives of each strip make contact with the adjacent strip.

9. The method of claim 8, wherein the top half of each strip is attached to the bottom half of the same strip with an adhesive.

10. The method of claim 8, wherein the top half of each strip is attached to the bottom half of the same strip by an ultrasonic weld.

11. The method of claim 8 further comprising:

cutting each strip in a transverse direction prior to stacking the strips.

12. The method of claim 8 further comprising:

allowing the first and second adhesives to dry prior to stacking the strips.

13. The method of claim 12, wherein the adhesives of each strip are activated by heating the stack of strips.

14. The method of claim 8, wherein the top half of each strip is attached to the bottom half of the same strip prior to applying first and second adhesives.

15. The method of claim 8, wherein the first and second adhesives are glue beads.

16. The method of claim 8, wherein the top half and the bottom half are of equal width.

17. A method of making a triple cell window shade comprising:

providing a length of material;

folding the length longitudinally to form a fold, two free ends, a top half and a bottom half, one of the halves having an outer surface;

attaching the top half to the bottom half along a first longitudinal line between the fold and the free ends, and along a second longitudinal line proximate the free ends;

applying a first adhesive to the outer surface along a line closer to the fold than the first longitudinal line;

applying a second adhesive to the outer surface along a line between the second longitudinal line and the first adhesive;

cutting the length of material into individual strips; and stacking the strips.

18. The method of claim 17, wherein the top half is attached to the bottom half with an adhesive.

19. The method of claim 17, wherein the top half is attached to the bottom half with an ultrasonic weld.

20. The method of claim 17, wherein the first and second adhesives are allowed to dry prior to stacking the individual strips.

21. The method of claim 17, wherein the first and second adhesives are glue beads.

22. The method of claim 17 wherein the first longitudinal line is located one-half the distance from the fold to the free ends.

23. The method of claim 17 wherein the first adhesive is applied along a line one-quarter of the distance from the fold to the free ends.

24. The method of claim 17 wherein the second adhesive is applied along a line three-quarters of the distance from the fold to the free ends.

25. The method of claim 17 wherein the top half and the bottom half are of equal width.

26. A method of making a multi-cell honeycomb product comprising:

providing a length of material;

folding the length longitudinally to form folded material, the folded material having a fold, two free ends, a top half, and a bottom half, one of the halves having an outer surface;

dividing the folded material into a plurality of longitudinal segments, one through N, the first segment beginning at the fold, the Nth segment ending at the free ends;

attaching the top half to the bottom half along lines located in selected segments;

applying adhesive lines to the outer surface along lines located in other segments;

cutting the folded material into a plurality of individual strips of material; and stacking the individual strips.

27. The method of claim 26, wherein the top half is attached to the bottom half with an adhesive.

28. The method of claim 26, wherein the top half is attached to the bottom half with an ultrasonic weld.

29. The method of claim 26, further comprising:

drying the adhesive lines prior to cutting the folded material; and heating the individual strips after stacking the strips.

30. The method of claim 26, wherein the adhesive lines are glue beads.

31. The method of claim 26, wherein the length of material is a continuous roll of material.

32. The method of claim 26, wherein N equals three.

33. The method of claim 26, wherein N is greater than three.

34. The method of claim 26 wherein the top half and the bottom half are of equal width.

35. The method of claim 26 wherein the top half is attached to the bottom half along lines located in even numbered segments.

36. The method of claim 26 wherein the adhesive lines are applied to the outer surface along lines located in odd numbered segments.

* * * * *